US007314045B2

(12) United States Patent
Eckert et al.

(10) Patent No.: US 7,314,045 B2
(45) Date of Patent: Jan. 1, 2008

(54) BOW STRING RELEASE HAVING FLOATING JAWS AND A TRIGGER FORCE ADJUSTMENT MECHANISM

(75) Inventors: Jeffrey A Eckert, North Fond du Lac, WI (US); Lynn A Tentler, North Fond du Lac, WI (US); Paul Peck, North Fond du Lac, WI (US)

(73) Assignee: Tru-Fire Corporation, North Fond Du Lac, WI (US)

( * ) Notice: Subject to any disclaimer, the term of this patent is extended or adjusted under 35 U.S.C. 154(b) by 0 days.

(21) Appl. No.: 09/916,636

(22) Filed: Jul. 26, 2001

(65) Prior Publication Data

US 2003/0019488 A1 Jan. 30, 2003

(51) Int. Cl.
*F41B 5/18* (2006.01)

(52) U.S. Cl. ..... 124/35.2

(58) Field of Classification Search ..... 124/35.2
See application file for complete search history.

(56) References Cited

U.S. PATENT DOCUMENTS

| | | | |
|---|---|---|---|
| 228,302 | A | 6/1880 | Beard |
| 750,988 | A | 2/1904 | Lotz |
| 1,542,159 | A | 6/1925 | Maxwell |
| 2,488,597 | A | 11/1949 | Konold |
| 2,819,707 | A | 1/1958 | Kayfes et al. |
| 2,936,749 | A | 5/1960 | Chellstorp |
| 3,672,346 | A | 6/1972 | Plumb |
| 3,921,615 | A | 11/1975 | Dodge |
| 3,948,243 | A | 4/1976 | Gazzara, Sr. |
| 3,954,095 | A | 5/1976 | Lewis |
| 3,998,202 | A | 12/1976 | Boyko |
| 4,036,204 | A | 7/1977 | Scott |
| 4,041,926 | A | 8/1977 | Troncoso, Jr. et al. |
| 4,062,339 | A | 12/1977 | Wilson |
| 4,066,060 | A | 1/1978 | Napier |
| 4,083,348 | A | 4/1978 | Fletcher |
| 4,105,011 | A | 8/1978 | Chism |
| 4,134,369 | A | 1/1979 | Cook |
| 4,151,825 | A | 5/1979 | Cook |
| 4,160,437 | A | 7/1979 | Fletcher |

(Continued)

OTHER PUBLICATIONS

TRU Ball Release Products catalog, not dated.

(Continued)

*Primary Examiner*—John A. Ricci
(74) *Attorney, Agent, or Firm*—Gerald E. Helget; Briggs and Morgan, P.A.

(57) ABSTRACT

A string release for providing accurate release of a tensioned bow string. The release has a pair of jaws which are retained and controlled by a pivot ball and a jaw cup. The pivot ball being mounted on a shaft which is attached to an inner race which is in turn contained within a ball housing. The inner race is positioned such that it may slide laterally within the ball housing. In the closed position, a number of balls retain the inner race in an aft position relative to the jaws. A trigger mechanism actuates a locking sleeve which allows the balls to move such that the inner race may slide forward, thereby allowing the jaw to open. The release further includes a trigger force adjusting mechanism that allows adjustment of the force required to activate the trigger mechanism.

21 Claims, 6 Drawing Sheets

U.S. PATENT DOCUMENTS

| | | | | |
|---|---|---|---|---|
| 4,249,507 | A | | 2/1981 | Marra |
| 4,257,386 | A | | 3/1981 | Gazzara |
| 4,282,851 | A | | 8/1981 | Lyons |
| 4,308,851 | A | | 1/1982 | Kaine, Jr. et al. |
| 4,403,594 | A | | 9/1983 | Todd |
| 4,407,260 | A | | 10/1983 | Lyons |
| 4,476,845 | A | | 10/1984 | Rickard |
| 4,509,497 | A | | 4/1985 | Garvison |
| 4,527,536 | A | | 7/1985 | Smith |
| 4,567,875 | A | | 2/1986 | Fletcher |
| 4,574,767 | A | | 3/1986 | Gazzara |
| 4,620,523 | A | | 11/1986 | Peck |
| 4,625,705 | A | | 12/1986 | Willits |
| 4,674,469 | A | | 6/1987 | Peck |
| 4,691,683 | A | | 9/1987 | Peck |
| 4,860,720 | A | | 8/1989 | Todd |
| 4,881,516 | A | | 11/1989 | Peck |
| 4,909,232 | A | | 3/1990 | Carella |
| 4,926,835 | A | | 5/1990 | Peck |
| 4,930,485 | A | | 6/1990 | Kopper |
| 4,949,698 | A | | 8/1990 | Burnham |
| 4,981,128 | A | | 1/1991 | Garvison |
| 5,009,214 | A | | 4/1991 | Wilde |
| 5,067,472 | A | | 11/1991 | Vogel et al. |
| 5,070,854 | A | | 12/1991 | Peck |
| 5,076,251 | A | | 12/1991 | Peck |
| 5,078,116 | A | | 1/1992 | Peck |
| 5,170,771 | A | | 12/1992 | Peck |
| 5,170,772 | A | | 12/1992 | Hamm |
| 5,247,921 | A | | 9/1993 | Todd |
| 5,261,581 | A | | 11/1993 | Harden, Sr. |
| 5,263,466 | A | | 11/1993 | Peck |
| 5,307,788 | A | | 5/1994 | Peck |
| 5,318,004 | A | | 6/1994 | Peck |
| 5,357,939 | A | | 10/1994 | Tentler et al. |
| 5,370,102 | A | | 12/1994 | Peck |
| 5,417,197 | A | * | 5/1995 | Bankstahl ..... 124/35.2 |
| 5,558,077 | A | | 9/1996 | Linsmeyer |
| 5,564,407 | A | * | 10/1996 | Linsmeyer ..... 124/35.2 |
| 5,582,158 | A | * | 12/1996 | Linsmeyer ..... 124/35.2 |
| 5,595,167 | A | | 1/1997 | Scott |
| 5,596,977 | A | | 1/1997 | Scott |
| 5,653,213 | A | | 8/1997 | Linsmeyer |
| 5,680,851 | A | | 10/1997 | Summers |
| 5,680,852 | A | | 10/1997 | Tentler et al. |
| 5,685,286 | A | | 11/1997 | Summers |
| 5,715,805 | A | | 2/1998 | Summers et al. |
| 5,765,536 | A | | 6/1998 | Scott |
| 5,803,068 | A | | 9/1998 | Summers |
| 5,850,825 | A | | 12/1998 | Scott |
| 5,871,004 | A | * | 2/1999 | Garvison ..... 124/35.2 |
| 5,941,225 | A | | 8/1999 | Tentler et al. |
| 6,032,661 | A | | 3/2000 | Goff et al. |
| 6,058,919 | A | | 5/2000 | Davis |
| 6,058,920 | A | | 5/2000 | Tentler |
| 6,173,706 | B1 | | 1/2001 | McConnell |
| 6,173,707 | B1 | | 1/2001 | Howell et al. |
| 6,205,991 | B1 | | 3/2001 | Summers et al. |
| 6,213,113 | B1 | | 4/2001 | Groover et al. |
| 6,237,584 | B1 | | 5/2001 | Sims |
| 6,247,467 | B1 | | 6/2001 | Siegfried |
| 6,302,093 | B1 | | 10/2001 | Holland |

OTHER PUBLICATIONS

TRU Ball Release Products catalog, 1997, p. 4.
TRU Ball Release Products catalog, not dated.
HHA Sports 1997 Archery catalog.

* cited by examiner

BOW STRING RELEASE HAVING FLOATING JAWS AND A TRIGGER FORCE ADJUSTMENT MECHANISM

BACKGROUND OF THE INVENTION

1. Field of the Invention

The present invention is generally related to a bow string release and is specifically directed to a release having a floating jaw and a free floating trigger with a force adjustment mechanism.

2. Description of the Prior Art

Mechanical archery bow string releases have become increasingly popular in recent years because they provide uniform control of the bow string and increase accuracy by effecting the consistent, controlled release of the arrow. Bow string releases are typically used to maintain the bow string in a cocked position in which the bow string is flexed against the tension of the bow for propelling the arrow supported on the bow string.

When a drawn arrow is released from a release mechanism, the release is usually relatively rapid and at a point approximately in line with the centerline of the bow so that the bow string delivers most of its thrust directly along the major axis of the arrow. When tabs or fingers are used to release a bow string, the bow string tends to roll off the fingers or tab and be deflected sideways during release such that the bow string follows a serpentine path, failing to maximize energy delivery directly along the major axis of the arrow.

The arrow itself is generally comprised of a shaft with a point mounted on one end and a nook mounted on the opposite end. A standard arrow neck has a bow string receiving groove or notch defined by spaced apart legs extending from a base. The neck is configured to receive a bow string and insure stability of the arrow when the bow string is drawn and released. When an arrow is loaded on a bow in this manner, the legs of the arrow neck extend beyond the bow string toward the archer such that and arrow can rotate about the bow string. When engaging the bow string, the neck is preferably seated at or near the mid-pint of the bow string to insure that the flight of the arrow is as true as possible.

The majority of the bow string releases have a body or casing which houses the sear and trigger mechanisms. The body is typically a cylindrical or rectangular design with the pivotable jaws of the sear mechanism positioned at one end and a trigger located along the length of the body. The release employs a trigger mechanism to activate the bow string retaining and release mechanism. The jaws and trigger mechanism of the bow string release are traditionally secured to the body with linkages or pins, which serve as a pivot mechanism for the jaws and trigger.

U.S. Pat. No. 5,596,977 describes a bow string release having a cylindrical body housing a trigger mechanism, release mechanism and jaws, wherein pins are used to attach each element to the body and the pins also serve as a pivot for the jaws. The release is composed of a cylindrical body with the jaw mechanism containing one fixed jaw and one pivotal jaw. The jaws pivot action is supported by a pin that extends transversely through the cylindrical body. The jaw employs an additional pin, located on the rearward end, away from the bow string, to anchor the jaw to the body when the jaw pivots. The trigger mechanism is located within the cylindrical body with the finger enabling trigger located along the body on the same side as the pivotable jaw. The '977 patent further describes a trigger mechanism, wherein the trigger pivots about a pin that transverses the cylindrical body. The pin permits the finger engageable trigger to pivot and thereby engage the release mechanism.

The repeated use of a bow string release may wear down the pivot pins resulting in a pin that either does not pivot, which is undesirable. The use of pins to provide a pivot point is especially undesirable under conditions in which bow string releases are typically used, where the environment may include rain, snow, water, mud or other debris that could clog, disable or otherwise hinder pivot pin based releases because the pivot pins are not protected from the environment by the body therefore they are susceptible to environmental conditions. The integration of the pivot pin into the body and the sear mechanism may make the replacement of the jaws more difficult if not impossible.

Bow string releases may also contain a trigger adjustment mechanism which permits the control of the trigger pressure. Trigger adjustment mechanisms usually operate by changing the position of one element of the release mechanism in relation to another and are usually dependent on changing the position of an element, which changes the contact angles, which in turn changes the pressure required to operate the trigger.

A trigger adjustment mechanism can be found in U.S. Pat. No. 5,596,977. The amount of force necessary to be exerted on the trigger in order to release the pivot jaw is controlled by the position of the trigger mechanism which is controlled by a set screw.

It has been found that many commercial bow string releases, including a release referred to as a Tru-Ball "Tornado" release, "load up" severely as pulling force on the bow string is increased. "Loading up" is a phenomenon whereby the force required of the archer to pull the trigger and release the bow string increases as the effective draw weight of the bow increases. Thus, at higher effective draw weights, the archer must pull harder on the trigger, perhaps causing a decrease in sensitivity and performance. A harder trigger pull may also cause a jerking trigger release motion, causing erratic arrow flight.

There are two common trigger sensitivity adjustment mechanisms used widely. In one mechanism, the depth of engagement of sear elements is varied. This affects trigger pull length, also known as trigger travel distance, and indirectly affects pull force required by making the trigger travel farther to disengage the sear, which in turn increases the sliding friction. An example of this mechanism is U.S. Pat. No. 5,680,851 to Summers.

Another mechanism is a single roller on one sear element, sear element, typically mounted on one jaw, positioned in an angled slot in the other sear element, typically a slot in the trigger. Examples include a release known as the Scott Caliper release. In this mechanism, a roller is used to reduce friction between the sear elements. Adjustment is related to the positioning of a roller's center in relation to the edge of the angled slot. This limits the upper end range of trigger force required due to the rolling force in the slot. At the lower end of the pull force range, the roller center is balanced on or just outside the slot edge. If the roller center is outside the slot edge, the release will not stay closed during bow draw unless a force is applied to overcome the center over the edge condition created.

The set screw sets the sear at a distance so that the roller on the pivot jaw resists movement thus resulting in the need to increase the pressure necessary to engage the roller and move the pivotable jaw. The set screw can also set the sear distance to reduce the pressure necessary for the trigger to engage the roller and move the pivotable jaw.

The major drawbacks to some prior art systems of trigger adjustment is to control trigger pressure you must control trigger travel which requires the movement of the sears within the release mechanism, which in turn requires the adjustment of screws housed in the body or release mechanism. These screws are difficult to reach for adjustment and typically require special tools. Additionally, the screws do not have a mechanism that will enable one to calibrate or predict the level of trigger force.

The necessity of using the screw and/or special tools may make it difficult or impossible to adjust trigger pressure in the field where the screw may be too small to adjust or the environment may prevent the use of tools to adjust the trigger pressure. The tool as a separate element, the piece may be lost or dropped, rendering the trigger force adjusting mechanism virtually unusable.

Furthermore, as described above, the environments in which a bow string release device are typically may further frustrate use of a tool/screw configuration of the Scott patents, rendering the adjustment mechanism difficult to manipulate. For example, a gloved archer may have difficulty manipulating the small screw of the Scott patent, or debris may clog the holes used to adjust the trigger pressure.

SUMMARY OF THE INVENTION

The present invention provides a bow string release mechanism having free floating jaws, a free floating trigger mechanism and a trigger pressure adjustment mechanism for adjusting the force required on the trigger mechanism to fire the release. The release mechanism includes a trigger mechanism, a housing, a calibrated trigger pressure adjusting mechanism, and a sear head attached to the body and actuable by the trigger mechanism.

The release mechanism further includes and over-center jaw control system allowing improved control of jaw movement and position. In one embodiment, the over-center design utilizes a rotatable ball and socket system that allows the jaws to pivot, rotate, and tilt relative to and independent of the body, thereby creating floating jaws. The over-center design permits the bow string release to utilize jaws that are not integral to the triggering elements. The over-center design of the present bow string release creates a durable release that can withstand both the environment and repeated use.

The separation of the jaws from the triggering element permits the elimination of a number of components common in prior art bow string releases, resulting in reduced manufacturing costs and increased reliability. The separation of the jaws and trigger element removes the pins, linkages, and molded tabs or heads attached to the housing of the jaw, all of which were common features of the prior art.

Furthermore, the separation of the trigger element and jaws allows the user to avoid applying force to the back of the trigger to maintain a closed jaw position to retain a drawn bow string. The bow string release of the present invention also provides a finger engagable trigger which is not dependent on pivot pins. A trigger mechanism without a pivot pin is desirable because it reduces or eliminates the problems caused by wear or environmental exposure, and creates a more durable and dependable trigger mechanism. In addition, the trigger may be rotated a full 360 degrees allowing for an individual user to position the trigger in the most comfortable and easy to use position.

The bow string release of the present invention also provides a trigger force adjusting mechanism. The trigger force adjusting mechanism provides a predictable calibrated adjustment of trigger force without increasing or decreasing trigger travel by separating the trigger adjustment mechanism from the trigger, a feature that will also prevent the trigger adjustment from moving out of adjustment after repetitive use. The tool-less nature of the trigger pressure adjusting mechanism provides an advantage over prior art releases which typically require screw drivers or other small, specialized wrenches, such as miniature allen wrenches, to adjust the trigger force. The bow string release of the present invention employs a trigger adjustment dial that can be manually adjusted, thus permitting instant finger tip control without the use of any tools. In addition to the tool-less dialing, the dial has a clicker assembly, or a silent detent assembly, that allows the user to adjust the trigger force in equal increments, to feel the force at each increment, to maintain a setting, and to lock a setting permanently. The utilization of the tool-less force adjusting mechanism permits the easy control of the force of the trigger and does not allow the mechanism to change setting over time, such as through repeated use.

The release of the present invention can be attached to any type of release body structure, such as a hand-held or wrist strap style release, including for example but not by limitation Tru-Fire BearPaw® release, a release known commercially as Winn Free Flight release, a Cobra Armstrong type glove, wrist strap styles such as used on a Tru-Fire Storm release (not shown) or a strap described in U.S. Pat. No. 4,831,997 to Greene, and hand-held styles (not shown). The release body structure is not the subject of the present invention, and the coupling of a release to a release body structure is well known in the art.

DETAILED DESCRIPTION OF THE PREFERRED EMBODIMENTS

Figure 1:
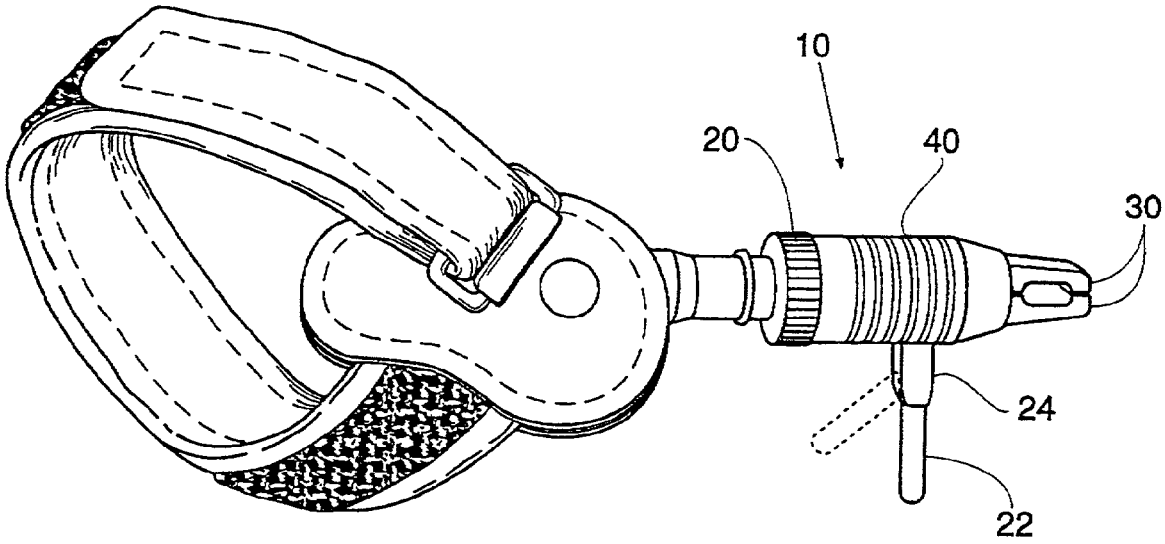
FIG. 1 is a perspective view of a bow string release mechanism of the present invention.

The bow string release of the present invention is shown on in FIG. 1 and is designated generally by the numeral 10. The release includes a body or housing 40 which carries the trigger removable peg trigger 22, trigger ring body 24, jaws 30, and a adjuster dial 20. The adjuster dial 20 may be rotated to adjust trigger sensitivity, or the force required to pull the trigger to release the bow string.

The removable peg trigger 22 may be positioned to be engaged by the index finger or the thumb, depending on the preference of the user. In the preferred embodiment, the jaws 30 are pivotably mounted against a jaw cup 72 (not shown on FIG. 1), as will be described later.

The housing 40 of the release 10, is typically of a molded construction and may be either a one piece or two piece design. If the housing 40 is formed from two pieces, the two mated halves are adapted to be held together with mechanical fasteners, for instance, threaded screws or the like. In the preferred embodiment, the housing 40 is a single molded piece designed to receive the mechanical assemblies of the release, as is well known in the art.

Figure 2:
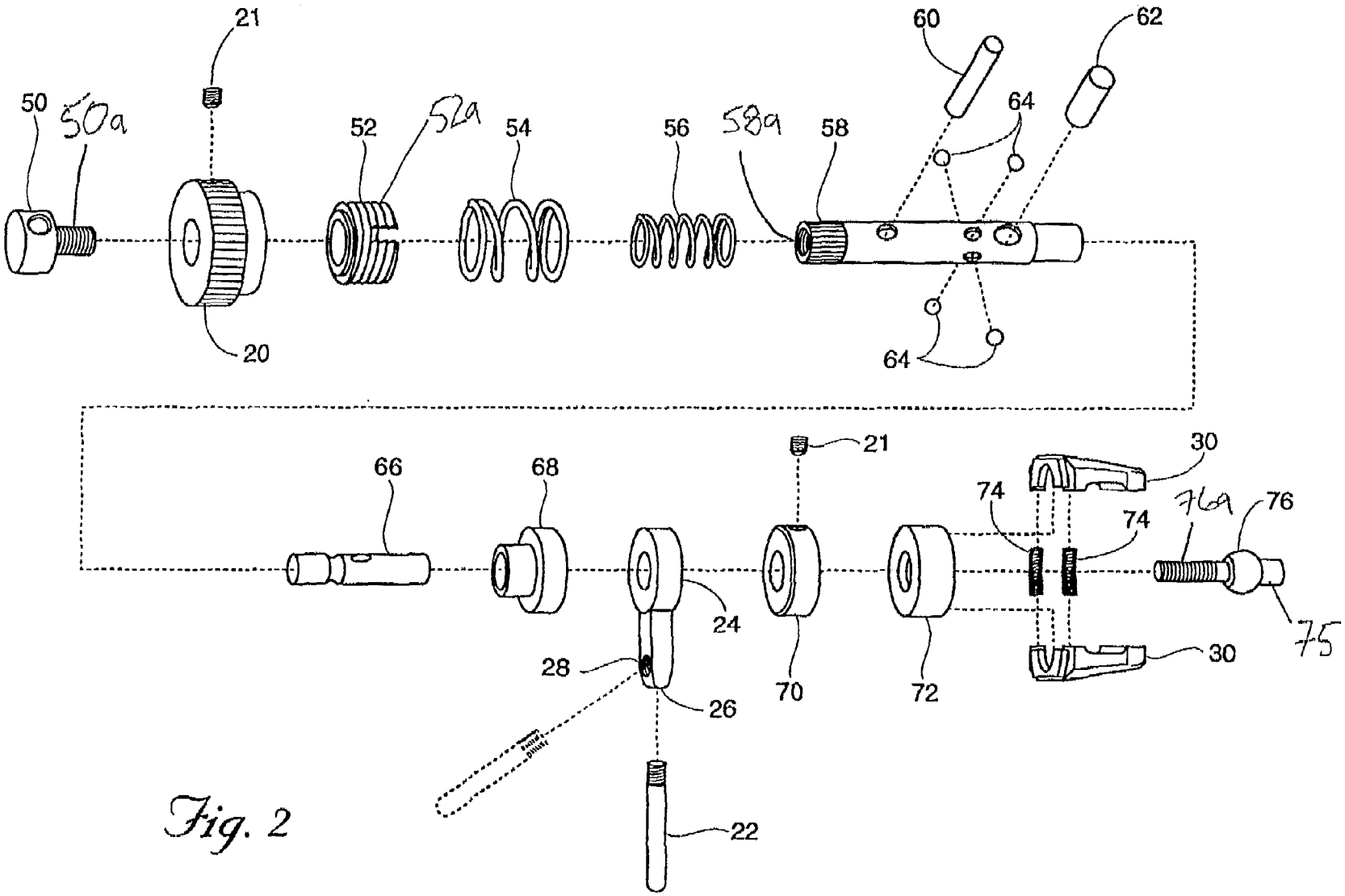
FIG. 2 is an exploded perspective view of selected components of a disassembled release.

Referring now to FIG. 2, an exploded perspective view of selected components of a disassembled release are shown in a preferred embodiment. At the rear, shown in the upper left of FIG. 2, an end screw 50 is provided for coupling to a ball housing 58 through a void in the adjuster dial 20 and void in a threaded adjuster 52. A preferable construction detail is that the end screw 50 has male end screw threads 50*a* for coupling with female threads 58*a* provided on the ball housing 58*a*.

The threaded adjuster 52 preferably has male threads 52*a* as shown to couple with female threads (not shown) provided within the adjuster dial 20.

Outer compression spring 54 and inner compression spring 56 are provided about the ball housing 58. Outer compression spring 54 and inner compression spring 56 each are compressed between the threaded adjuster 52 and a locking sleeve 68.

It should be noted that two compression springs 54 and 56, instead of only a single spring, are provided as a preferable construction detail. If only one compression spring were provided, the compression spring would have to be manufactured to tolerances that are outside of the scope of ordinary spring manufacturing technology, and would require expensive additional manufacturing steps.

The ball housing 58 may have a plurality or holes or opening for receiving fasteners used to mount various components of the release to the ball housing 58. The locking sleeve 68 is slidably mounted about the ball housing 58, generally on a position between a drive pin 60 and a plurality of ball bearings 64 as they are positioned on the ball housing 58. Drive pin 60 and pin 62 are placed within voids on the ball housing 58.

The ball housing 58 is located centrally in the release 10 and interacts directly or indirectly with other mechanisms of the release 10. The ball housing 58 is a hollow tube, which may be of any suitable shape, for instance, round, hexagonal or square having a first, forward end and a second rearward end. The forward end of the ball housing 58 may be internally threaded to receive the pivot ball 76. The rearward end of the ball housing 58 may be internally threaded to receive a strap subassembly (not shown) or an end screw 50, which may be coupled with a strap subassembly. In the preferred embodiment, the rearward end of the ball housing 58 is externally splined to provide a surface over which a adjuster dial 20 may ride. Although any number of splines may be present on the rearward end of the ball housing 58, typically, the ball housing 58 has 10-15 splines.

An inner race 66 is sized to fit within the hollow interior of the ball housing 58. The inner race 66 has a void through for receiving pin 62, and the inner race 66 also has a channel about its circumference adapted to receive ball bearings 64 when the ball bearings 64 are placed in voids on the ball housing 58. Although a preferred number of four ball bearings 64 are shown, more or less than four may be employed based on construction preference. The geometry of the locking sleeve 68 will be described later, and its interaction with ball bearings 64, inner race 66 and ball housing 58.

The inner race 66 is preferably equipped with female threads (not shown) for coupling with male threads 76*a* provided on a ball member 75 carrying pivot ball 76. Coupling the pivot ball member 75 with the inner race 66 holds in stacked relationship the locking sleeve 68, the trigger ring body 24, a trigger sleeve 70, and a jaw cup 72.

Rear ends of jaws 30 are urged within the jaw cup 72 by pivot ball 76 carried by ball member 75. Jaw springs 74 are provided between the jaws 30 to urge the jaws 30 apart during jaw opening such that the jaw springs 74 are compressed when the jaws 30 are in the closed position, thereby exerting an opening force on the jaws 30.

Set screws 21 are preferred where shown on FIG. 2 to maintain spatial relationship between components. A preferable construction detail is that set screws 21 are small hex heads, operable by use of an allen wrench (not shown).

Figure 3:
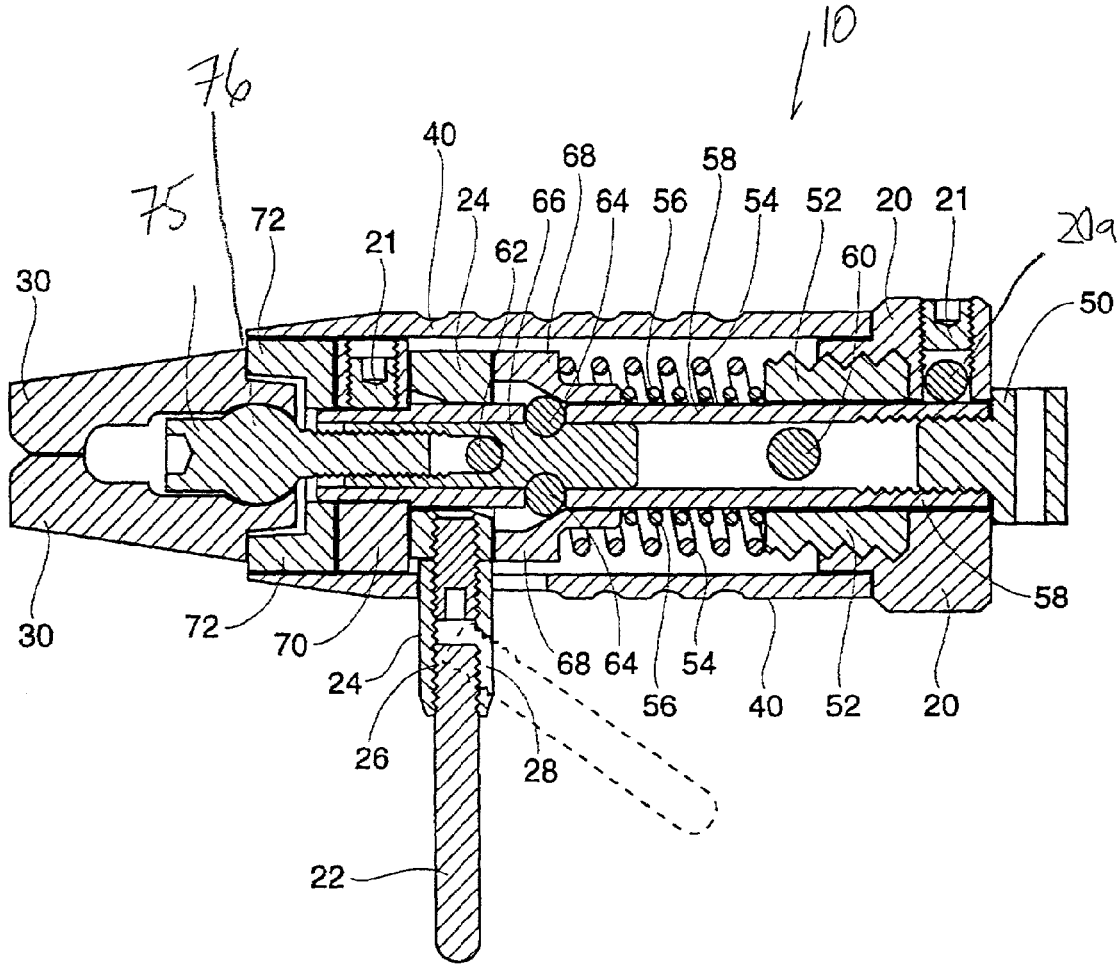
FIG. 3 is an cross-sectional view of the release of the present invention.

Referring now to FIG. 3, a cross-sectional view of the release 10 is shown in a closed position, as assembled.

Jaws 30 are pivotably and rotatably mounted using an over-center jaw control system. The system is characterized by the pivot ball member 75 which passes in part between and retains the jaws 30. The jaws 30, while allowed to pivot relative to the jaw cup 72, are held in place with the pivot ball 76. The pivot ball 76 is located on the ball member 75 member which passes through a hole in the center of the jaw cup 72 and threadably engages the inner race 66. It should be understood that while one embodiment of the present invention uses a pivot ball 76 to retain the jaws 30, any suitable over-center system may be used. For instance a screw and thrust washer may be used with jaws 30 having a counter bore (as opposed to a race) to accept the washer or a stationary center member may be used in combination with a movable jaw cup 72.

Typically, the ball member 75 is a socket headcap screw. The jaws 30 may rotate 360 degrees around an axis of the body and are also tiltable relative to the housing 40. Each jaw 30 provides at least a portion of a race into which the pivot ball 76 is seated. In this way, the jaws 30 may self-align in both the open and closed position. Preferably, the jaws 30 have a non-elongated rectangular shape and are made from a heat treatable powder metal alloy. Still referring to FIG. 3, the ball bearings 64 are shown resting in the channel of the inner race 66.

The jaw cup 72 is positioned directly behind the jaws 30 and surrounds the pivoting end of the jaws 30. The jaw cup 72 also provides a pivot ring on which the outer edges of the jaws 30 pivot. When the ball member 75 moves away from the jaw cup 72, the free ends of the jaws 30 are allowed open. The compression springs in the jaws 30 allow for quicker opening. In one embodiment, the jaw cup 72 is rotatable about the ball member 75 and serves as a thrust washer to aid in rotation of the jaws 30, in addition, the jaw is fixed to allow the jaws 30 to pivot outwardly when the ball member 75 moves away from the jaw cup 72. It should be understood, however, that in the over-center system employed in the present invention, the jaw cup 72 may be non-rotatable or may be capable of moving longitudinally along the ball member 75 and/or ball housing 58 to actuate the jaws 30 open and closed.

The jaw cup 72 is prevented from moving backwards, away from the jaws 30 by the trigger sleeve 70. The trigger sleeve 70 is mounted around the ball housing 58 and is typically fixed in place using a pin or screw 21, although any suitable method of preventing the trigger sleeve 70 from rotating or moving longitudinally may be used. The trigger sleeve 70 also provides a pivot point for the trigger ring body 24.

The present invention employs a multiple action, dual position trigger system. The trigger ring body 24 is mounted circumferentially on the ball housing 58. The trigger ring body 24 is pictured in FIG. 3 as a two-piece component, and as this shows, the trigger ring body 24 can be constructed with more than one piece. As is also shown in FIG. 3, the trigger ring body 24 has a diameter slightly smaller than an inner diameter of the housing 40 to facilitate pivoting about the ball housing 58, as will be described later. A threaded hole is typically formed in the trigger ring body 24 to allow the attachment of the removable peg trigger 22, which is preferably threaded for coupling with either a trigger receiver 26, or an alternate trigger receiver 28. The removable peg trigger 22 may be attached by any suitable means, but is preferably threadably engaged to the trigger ring body 24.

By disconnecting the removable peg trigger 22 from the trigger receiver 26 and replacing removable peg trigger 22 in alternate trigger receiver 28, the user is allowed to alternate trigger placement between a first traditional pull to fire position, such as a traditional firearm style, and a second push to fire position, wherein the trigger is squeezed by a thumb or finger to fire.

The trigger system may be activated at any position about the ball housing 58. In the preferred embodiment, the removable peg trigger 22 is in a first position wherein the removable peg trigger 22 is positioned substantially downward and is activated by pulling the removable peg trigger 22 toward the user. In an alternate embodiment, the removable peg trigger 22 may be rotated 180 degrees to face substantially upwards, in this way, the removable peg trigger 22 is activated by squeezing toward the body of the release.

The release locking mechanism comprises the inner race 66, balls 64, the ball housing 58 and the locking sleeve 68. Typically, the inner race 66 is threaded at one end to receive the ball member 75 and is grooved or slotted on the opposite end to receive the balls 64. In addition, the inner race should slide longitudinally in the ball housing 58. The inner race 66 provides a link between the jaws 30 and the locking sleeve 68. Preferably, the inner race 66 is round, however, any suitable shape may be used, for instance, hexagonal and square shaped races are suitable. The ball housing 58 functions as a linear bearing and ball cage.

Figure 4:
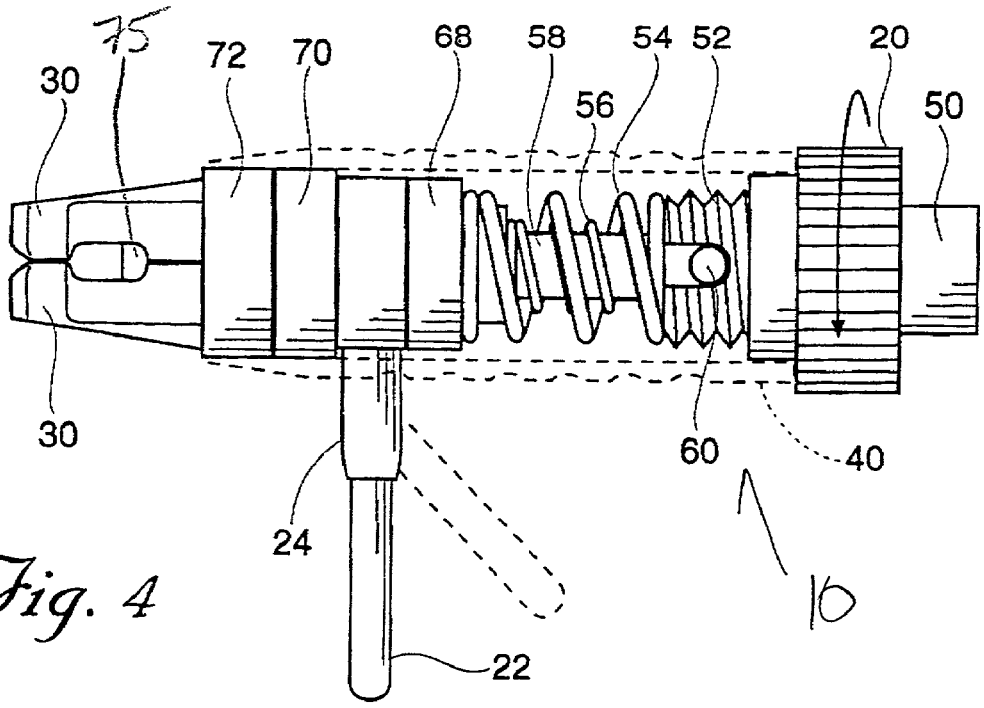
FIG. 4 is a plan view, with portions broken away, of a bow string release mechanism in a closed condition.

Referring now to FIG. 4, a plan view of the release 10 is shown in a closed position, as assembled, with portions broken away. By rotating the adjuster dial 20 in the direction shown, outer compression spring 54 and inner compression spring 56 are compressed by threaded adjuster 52 moving generally away from end screw 50. The tighter compression of outer compression spring 54 and inner compression spring 56 requires the user to apply more force to the trigger 22 or trigger ring body 24 to release the bow string.

The release 10 of the present invention includes a trigger force adjusting mechanism for varying the pressure required on the trigger pin 22 or the trigger ring body 24 to open the jaws 30. This is accomplished with no change in the travel distance of the trigger pin 22 or the trigger ring body 24, meaning that regardless of the desired trigger force, the trigger pin 22 or the trigger ring body 24 can travel the same distance. In addition, the trigger force may be adjusted without the use of tools.

The outer compression spring 54 and the inner compression spring 56 are positioned between the threaded adjuster 52 and the rearward, receiver end of the locking sleeve 68. The compression springs 54 and 56 serve two purposes. First, they exert a forward force against the locking sleeve 68 which aids in positioning the release in a closed or string retaining position. The release 10 is balanced so that very little of the force developed by the compression springs 54 and 56 is used to keep the jaws 30 closed. Second, the compression springs 54 and 56 are used to develop a force which resists the trigger's deployment. Because the release 10 is designed to adjust trigger force without changing the position of sear elements, the release 10 may not be adjusted to a point at which the locking mechanism cannot handle the draw weight of the bow string, thereby causing a dangerous condition and potential misfire.

The threaded adjuster 52 is preferably an externally threaded tube slidably mounted on the ball housing 58 opposite the jaws 30. As the threaded adjuster 52 slides forward, toward the jaws 30, the spring is compressed, thereby increasing trigger force resistance. Opposing guide slots are formed in the threaded adjuster 52, extending from the end closest the jaws 30 to a point approximately midway down the length of the adjuster 52. The drive pin 60, which passes through a corresponding hole in the ball housing 58 allows the threaded adjuster 52 to be moved forward until the drive pin 60 contacts the end of the slots, thereby preventing the adjuster 52 from moving excessively forward.

The adjuster dial 20 is preferably an internally threaded, cylindrical body having an opening in the center for engaging the threaded adjuster 52 such that rotation of the adjuster dial 20 moves the threaded adjuster 52 longitudinally along the ball housing 58. The adjuster dial 20 allows the user to adjust the trigger force required to open the jaws 30 without the use of tools. The adjuster dial 20 moves the threaded adjuster 52 between a forward, high force setting and a rearward, low force setting. The release 10 provides a positive stop for the dial to ensure that the trigger force cannot be adjusted into an unacceptably low, unsafe condition.

The adjuster dial 20 preferably, but is not required to have, an increased friction surface, for instance, a knurled surface to improve the users grip on the dial. The increased friction surface aids especially when the release 10 is used in cold or wet conditions.

In a preferred embodiment, the adjuster dial 20 will contain a clicker assembly or a silent detent assembly. The clicker assembly is mounted in an opening which extends partially through a wall of the adjuster dial 20. In the preferred embodiment, the clicker assembly comprises a clicker ball 20*a* (best shown in FIG. 3) which rides over the splined end of the ball housing 58, a clicker spring (not shown) in contact with the clicker ball 20*a* to develop a resisting force thereon, and a clicker set screw 21 which threadably engages the adjustment dial and which maintains the clicker spring in contact with the clicker ball 20*a*. The clicker assembly maintains the user selected trigger force setting and may be adjusted to lock the setting permanently. In addition, the clicker assembly provides feedback to the user, in the form of silent clicks, regarding the specific trigger force setting of the release 10. In this way, a user can quickly and accurately adjust the release to a specific, desired setting.

The adjuster dial 20, threaded adjuster 52 and clicker assembly provide a mechanism by which the trigger force necessary to open the jaws 30 may be adjusted without altering the length of the trigger pull and the trigger force adjustment set by the user will not change through repeated use.

Figure 4A:
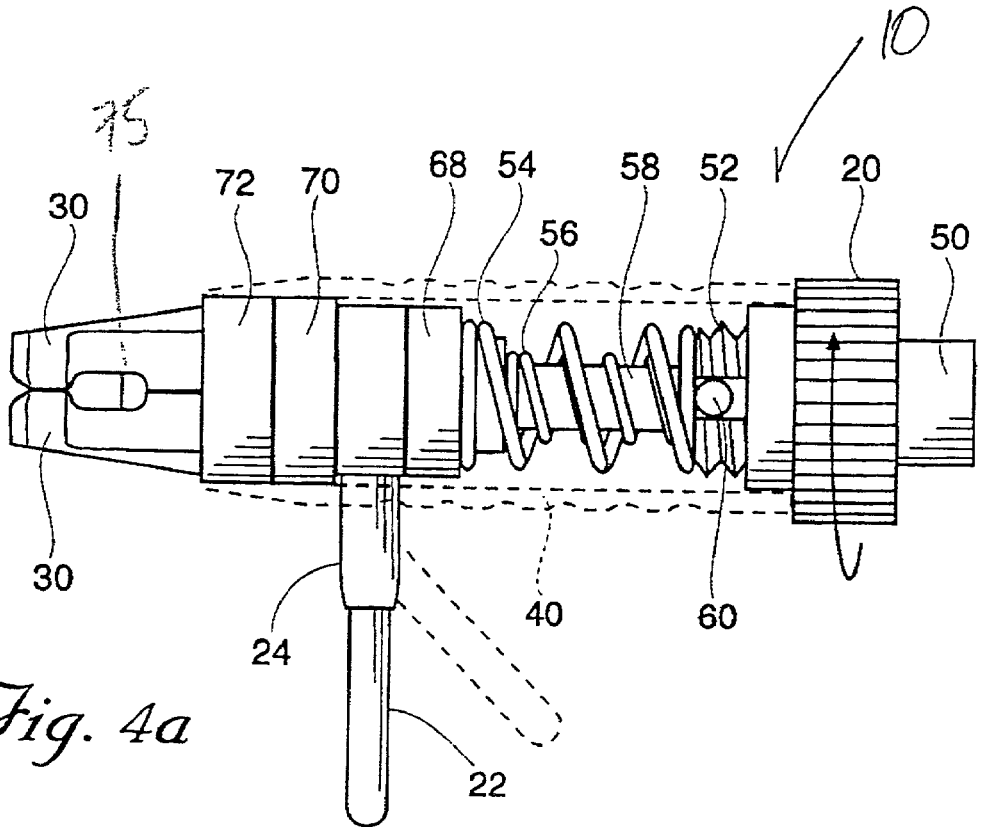
FIG. 4*a* is a plan view, with portions broken away, of a bow string release mechanism in a closed condition.

In comparison to FIG. 4, FIG. 4*a* shows an adjustment by rotating the adjuster dial 20 in the direction shown on FIG. 4*a*, outer compression spring 54 and inner compression spring 56 are decompressed by threaded adjuster 52 moving generally closer to end screw 50. The looser compression of outer compression spring 54 and inner compression spring 56 requires the user to apply less force to the trigger 22 or trigger ring body 24 to release the bow string.

Figure 4B:
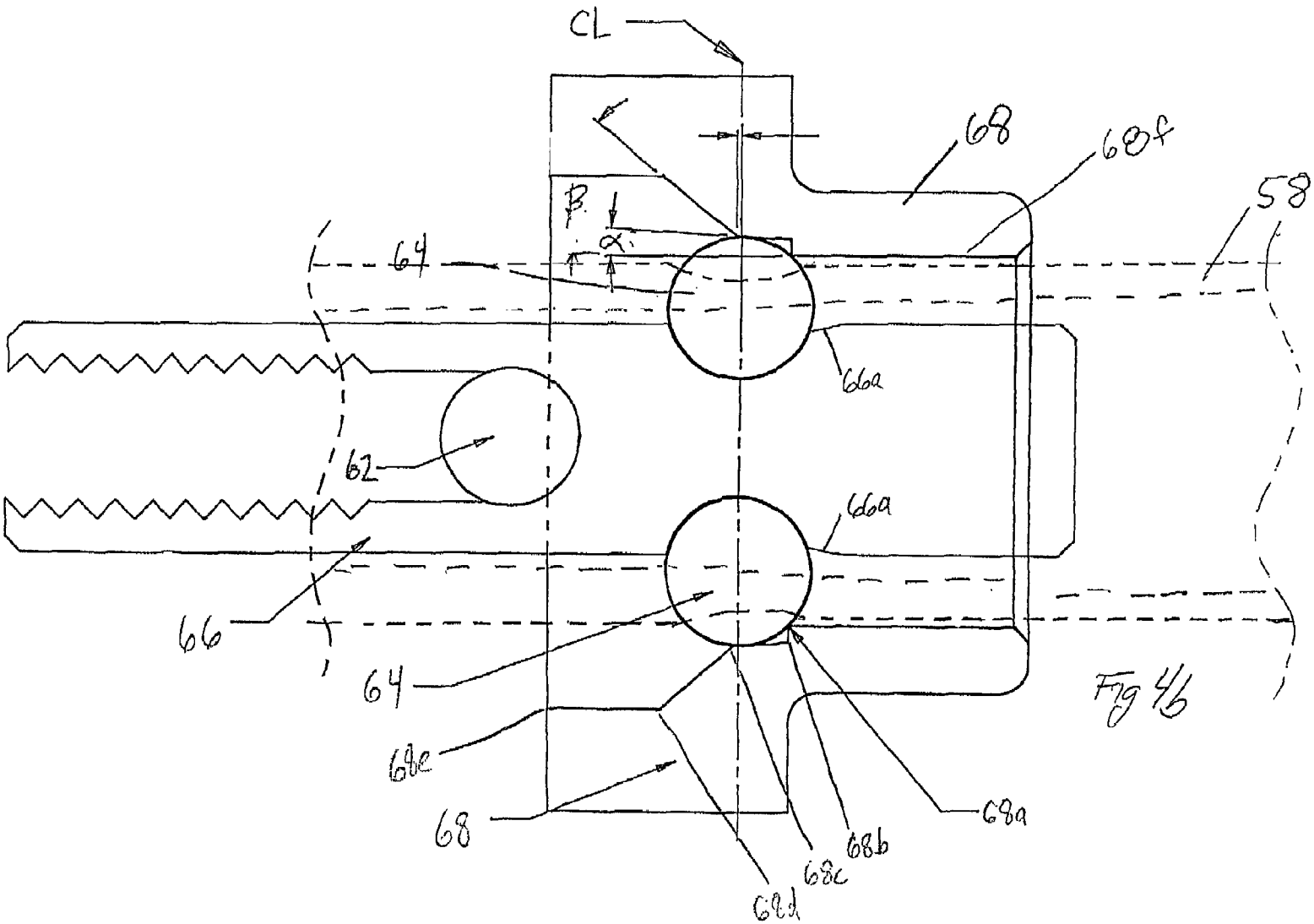
FIG. 4*b* is a cross sectional view of portions of a bow string release mechanism in a closed condition.

Referring now to FIG. 4*b*, the balls 64 are in the channel of the inner race 66 only when the jaws 30 are in the closed position, in comparison to FIG. 5*a*, where the balls 64 are positioned out of the channel of the inner race 66 when the jaws are in the open position, as will be described later. In a preferred embodiment, the locking sleeve has the following geometry. The locking sleeve 68 is a moveable member which provides a first, inner generally cylindrical surface 68*f* which moves longitudinally on the ball housing 58.

The locking sleeve also has a second, inner generally cylindrical surface formed between points 68*e* and 68*d*. The second generally cylindrical surface has a larger bore than the first surface 68*f* and is capable of containing the balls 64 when the jaws 30 are in the open position.

The locking sleeve 68 provides a first ramped surface between points 68*c* and 68*d*, and a second ramped surface between points 68*c* and 68*b*, both of which are disposed between the first cylindrical surface 68*f* and the second cylindrical surface formed between points 68*e* and 68*d*. The first ramped surface between points 68*c* and 68*d* is generally larger than the second ramped surface between points 68*c* and 68*b*, and serves to guide the balls 64 into and out of the channel in the inner race 66 quickly and with minimum friction. The angle of the first ramped surface between points 68*c* and 68*d* can vary widely, and is denoted by angle $\alpha$. In a preferred embodiment, the angle $\alpha$ of the first ramped surface is 40 degrees, plus or minus 5 degrees. This allows an improved opening and closing of the jaws 30, as compared to ramped surfaces having greater or lesser angles.

Similarly, the second ramped surface, the angle denoted as $\beta$, begins rearward of the balls 64 when the balls 64 are seated in the channel of the inner race 66. The locking sleeve 68 has a positive stop 68*a*, which provides a stop for the balls 64 to hold the balls 64 in the closed position. Positive stop 68*a* also forms a step by the surfaces between 68*a* and 68*b*. The second ramped surface may extend past the balls, at which point it becomes tangent with the first ramped surface. Preferably, the second ramped surface $\alpha$ is angled at 3.5 degrees, plus or minus 0.5 degrees.

In the closed position, the balls 64 contact the locking sleeve 68 at point 68*a* and at some position on the second ramped surface between points 68*c* and 68*b*. The center line of the balls 64, denoted as CL, is located behind point 68*c* with reference to the jaws 30.

The locking sleeve 68 has three primary purposes. When positioned forward as shown on FIG. 4*b*, toward the jaws 30, i.e., when the release is in the closed position, first ramped surface between points 68*c* and 68*d* directs the balls through the passages in the ball housing 58 and into a locked or latched position in the channel of the inner race 66. When the locking sleeve 68 is positioned rearward as shown on FIG. 5*a*, away from the jaws 30, i.e., when the release is in the open position, the locking sleeve 68 may secure or contain the balls 64 between the first ramped surface between points 68*c* and 68*d* and the a second, inner generally cylindrical surface formed between points 68*e* and 68*d*. The rearward end of the locking sleeve 68 receives outer compression spring 54 and inner compression spring 56 that exert a forward force on the sleeve 68 to locate the sleeve 68 such that the jaws 30 are in a closed position.

Figure 5:
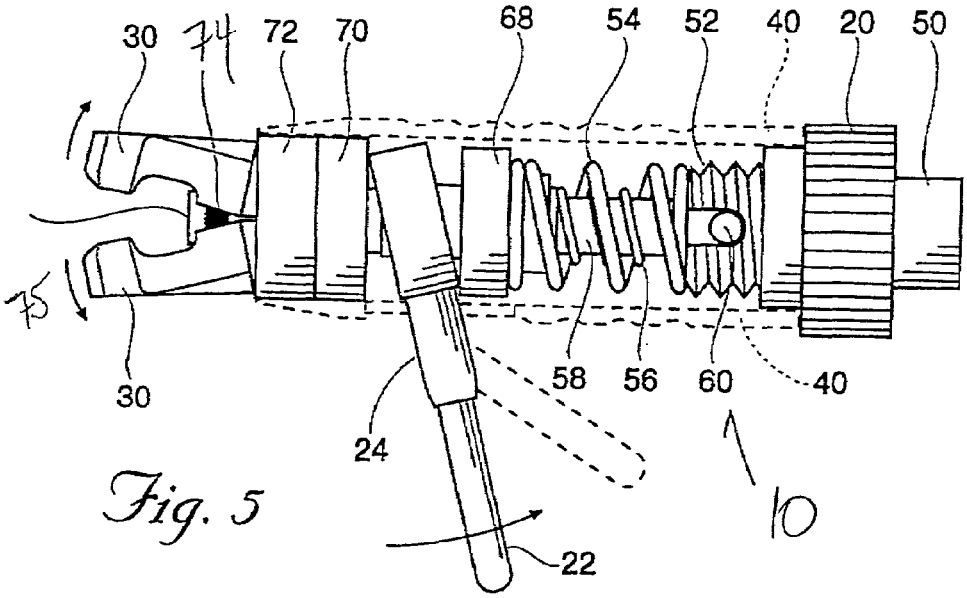
FIG. 5 is a plan view, with portions broken away, of a bow string release mechanism in an open condition.
Figure 5A:
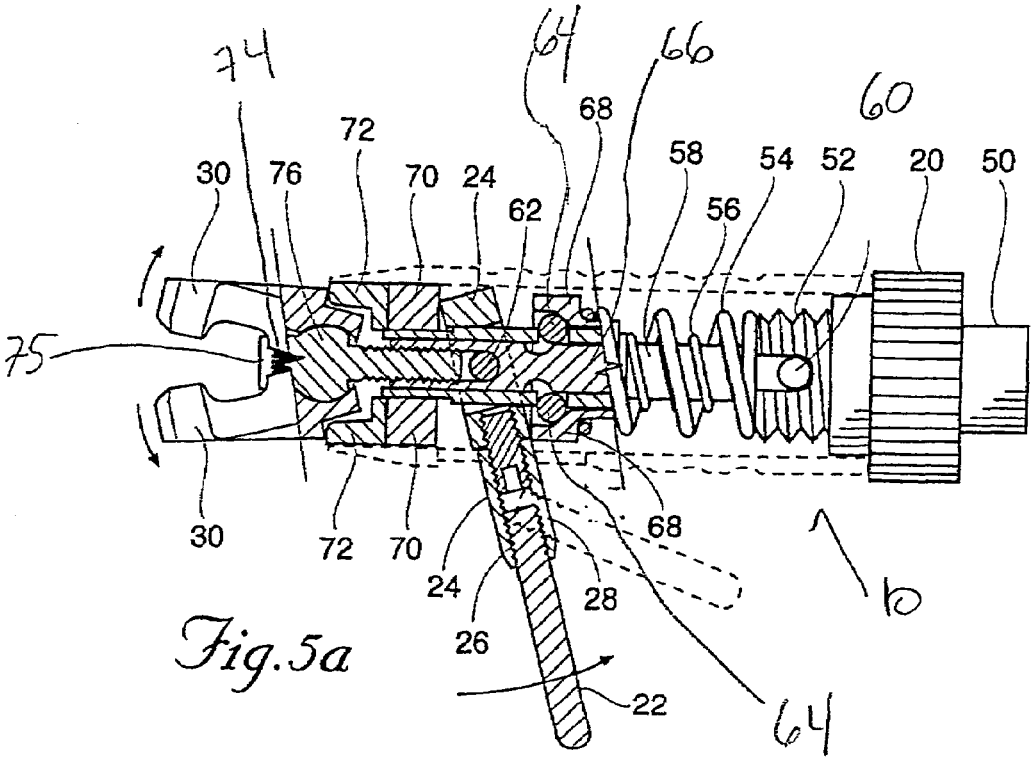
FIG. 5*a* is a cross sectional view, with portions broken away, of a bow string release mechanism in an open condition.

Referring now to FIGS. 5 and 5*a*, the release 10 is shown in an open position, either for grasping a bow string, or firing the bow string after the string has been grasp and the bow drawn back. To open jaws 30, the user pulls rearward on the peg trigger 22 as shown. For purposes of simplifying the discussion of trigger operation, we will refer to pulling on the peg trigger 22 to open the jaws, although it is understood that the user could also push the peg trigger 22 or trigger ring body 24 toward the housing 40 as previously described, or pull the trigger ring body 24.

When the user pulls the peg trigger 22, the trigger ring body 24 pivots about the ball housing 58. The end of the trigger ring body 24 farthest from the removable peg trigger 22 is urged against the trigger sleeve 70. The end of the trigger ring body 24 nearest to removable peg trigger 22 is urged against the locking sleeve 68 at a position on the locking sleeve 68 nearest to the removable peg trigger 22. When the locking sleeve 68 is urged by the trigger ring body 24, this causes the locking sleeve 68 to compress the compression springs 54 and 56. Referring momentarily to FIG. 4*b*, when the locking sleeve 68 moves rearward during the trigger pull, the centerline CL of balls 64 are urged past point 68*c* and slide down the first ramped surface between points 68*c* and 68*d*. To facilitate the initial sliding, a slightly slope surface 66*a* is provide on the inner race 66. Referring again to FIG. 5*a*, when the balls 64 are removed from the channel in the inner race 66, the inner race 66, and the ball member 75 to which it is coupled are forced forward, or the direction away from end cap 50, by the force of the trigger ring body 24 against the trigger sleeve 70. Simultaneously, jaw springs 74 urge the jaws 30 apart, and are allowed to do so because the jaws can, at their rearward end, pivot to the open position about pivot ball 76.

After pulling the peg trigger 22, the archer releases the peg trigger 22 to allow the jaws 30 to close. Compression springs 52 and 54 re-compress, urging the locking sleeve 68 back to its original position. The balls 64 return to the channel of the inner race 66 as originally positioned along the slopes of the locking sleeve 68. The locking sleeve 68 urges the trigger ring body 24 to its original position, which in turn returns the inner race 66 and the ball member 75, and in turn the jaws 30, all to their original closed condition.

The foregoing disclosure and description of the invention are illustrative and explanatory thereof, and various changes in the size, shape and materials, and components, as well as in the details of the illustrated construction may be made without departing from the spirit of the invention.

What is claimed is:

1. A bow string release for engaging and releasing a bow string, comprising:

a pivot ball mounted on a center member;

a pair of opposing jaws capable of receiving, at adjacent ends, the pivot ball, said jaws engaging and releasing the bow string;

a jaw cup on which outer edges of the jaws may pivot and a rearward floor for preventing the rearward movement of the jaws, said floor having a central orifice through which the center member passes; and a trigger mechanism for engaging and releasing the jaws.

2. The bow string release of claim 1, the release further comprising:

a trigger force adjustment mechanism for adjusting a force necessary to pull the trigger mechanism to release the bow string.

3. The bow string release of claim 2, wherein the trigger force adjustment mechanism is manually adjustable without the use of a tool.

4. The bow string release of claim 2, the trigger force adjustment mechanism comprising:

at least one compression spring for developing trigger force and aiding in the closing of a locking mechanism;

an adjuster dial engaged to an adjuster and capable of being rotated thereby moving the adjuster forward or rearward;

the adjuster mounted rearwardly of and engaging the compression spring, for varying the compression of the compression spring, thereby altering the force necessary to pull the trigger mechanism to release the bow string.

5. The bow string release of claim 4, wherein the adjuster dial is threadedly engaged with the adjuster.

6. The bow string release of claim 2, wherein the trigger force adjustment system further includes a detent assembly for maintaining accurate and repeatable adjustments of the trigger force.

7. The bow string release of claim 6, wherein the detent assembly does not produce an audible noise when the trigger force is adjusted.

8. The bow string release of claim 1, wherein the trigger mechanism is rotatable.

9. The bow string release of claim 1, the release further comprising a housing apparatus that carries the jaw cup.

10. The bow string release of claim 1, the release carried by a body structure selected from a group consisting of a wrist strap assembly, a glove assembly, and hand-held assembly.

11. The bow string release of claim 1, wherein the trigger mechanism includes a trigger connector having a plurality of threaded openings for receiving a trigger peg.

12. A bow string release for engaging and releasing a bow string comprising:

an axial ball housing;

a pivot ball carried by the axial ball housing;

at least two jaws carried by a jaw cup;

a trigger sleeve positioned adjacent to the jaw cup;

a trigger ring body carried by the axial ball housing;

a locking sleeve on the axial ball housing adjacent to the trigger ring;

a spring encasing the axial ball housing between the locking sleeve and an adjuster;

an adjuster dial coupled with the adjuster.

13. The bow string release of claim 12, the release further comprising a bias element between the jaws.

14. The bow string release of claim 12, wherein the axial ball housing threadedly receives the pivot ball.

15. A bow string release comprising:

a trigger lever having a constant trigger travel distance, a housing with a central axis extending between the front and rear of the housing and a manually adjustable trigger pressure adjustment mechanism substantially coaxial with the central axis of housing.

16. A bow string release comprising:

a housing having an axis substantially perpendicular to a bow string;

jaws; and means for rotating, pivoting, and tilting the jaws about the axis independently of the housing.

17. A trigger force adjustment mechanism for a bow string release comprising:

a compression spring;

an adjuster engaging the compression spring, for varying the compression of the compression spring, thereby altering a required trigger force;

an adjuster dial coupled with the adjuster and capable of being rotated thereby moving the adjuster forward or rearward;

whereby said adjuster maintains a constant trigger travel distance for a trigger.

18. A trigger force adjustment mechanism for a bow string release having a trigger requiring a trigger force to release a bow string, the trigger force adjustment mechanism comprising:

an adjuster dial;

an adjuster in cooperative communication with the adjuster dial and a trigger mechanism having constant trigger travel distance, the adjuster responsive to rotation of the adjuster dial to alter the trigger force to release the bow string.

19. A trigger force adjustment mechanism according to claim 18, the trigger force adjustment mechanism further comprising a compression spring carried between the adjuster and the trigger mechanism.

20. A trigger force adjustment mechanism according to claim 19, the trigger force adjustment mechanism further comprising a locking sleeve carried between the trigger mechanism and the compression spring.

21. A trigger force adjustment mechanism according to claim 20, the locking sleeve urging a plurality of ball bearings against an inner race.

* * * * *